United States Patent [19]

Delisle et al.

[11] Patent Number: 4,903,506

[45] Date of Patent: Feb. 27, 1990

[54] ICE CUBE MAKER

[76] Inventors: John Delisle, 1545 Quellette Ave., Apt. 1208, Windsor, Ontario, Canada, N8X 1K6; Wayne Delisle, 4285 Longfellow Ave., Windsor, Ontario, Canada, N9G 2B5; Alfred Delisle, 471 Tecumseh Blvd., Apt. 207, Windsor, Ontario, Canada, N8X 1G8

[21] Appl. No.: 183,443

[22] Filed: Apr. 13, 1988

Related U.S. Application Data

[63] Continuation-in-part of Ser. No. 14,385, Feb. 13, 1987, abandoned, which is a continuation-in-part of Ser. No. 799,507, Nov. 19, 1985, abandoned.

[51] Int. Cl.[4] ..... F25C 1/12

[52] U.S. Cl. ..... 62/347; 62/353; 165/170

[58] Field of Search ..... 62/71, 347, 348, 352, 62/353, 515; 165/139, 170; 29/157.3 D

[56] References Cited

U.S. PATENT DOCUMENTS

| | | | |
|---|---|---|---|
| 2,573,538 | 10/1951 | Brown, Jr. | 165/170 |
| 2,656,689 | 10/1953 | Muffly | 62/307 X |
| 3,430,452 | 3/1969 | Dedricks et al. | 62/347 X |
| 4,366,679 | 1/1983 | Van Steenburgh, Jr. | 62/347 X |

*Primary Examiner*—William E. Tapolcai

*Attorney, Agent, or Firm*—Hoffman, Wasson, Fallow & Gitler

[57] ABSTRACT

In a commercial ice cube making device, an accelerated freezing and harvest cycle is effected by employing parallel adjacent rectangular channel ways which are individually directly connected to intake and outflow manifolds, thereby producing even absorption and dispersion. In addition, melting of the cubes during the short harvest cycle takes place on one side only thereby reducing the problem of stored ice cubes freezing and sticking together. The ice cubes are made in novel nylon ice trays with combed partitions which allow ice to form from the vertically disposed evaporator outwards on both of its sides. The device advantageously produces large quantities of symmetrical non-sticky ice cubes more quickly and efficiently than the devices known in the prior art.

23 Claims, 9 Drawing Sheets

ICE CUBE MAKER

CROSS REFERENCE TO RELATED APPLICATIONS

This application is a continuation-in-part of applicants' co-pending patent application Ser. No. 014,385, filed on Feb. 13, 1987 a continuation-in-part of applicants' U.S. patent application Ser. No. 799,507, filed Nov. 19, 1985, now abandoned.

BACKGROUND OF THE INVENTION

1. Field of the Invention

This invention relates to ice producing devices and in particular to ice cube making devices for use on a commercial scale.

Ice cube making devices are known in the art. Numerous types, designs and sizes exist which produce fragmented, sheet, cube, cylindrical, or cup-shaped ice depending upon the molds. The demand for ice in restaurants and bars is particularly directed to clear clean symmetrical cubes in large quantities.

These problems currently exist in the known ice making art.

2. Description of the Prior Art

Slow Harvest Cycle

The rate of production of ice depends upon how quickly the freezing and harvest cycles take place. The slower the harvest cycle, the greater the loss of productivity of a machine. Moreover, the length of time which an apparatus takes to complete a defrost cycle is proportionate to the loss of the ice product itself. Severe losses can occur due to melting during the defrost cycle.

In early ice making devices the machine was simply shut off and the operator waited for the ice product to be released by melting and gravity. In recent times the cooling cycle is reversed, and the hot gaseous refrigerant is cycled through the evaporator assembly to hasten the cycle. Such a device is disclosed in U.S. Pat. No. 4,107,943.

In Canadian Patent No. 661,635 warm water is cascaded over the frozen cubes once the freezing cycle is finished, in order to hasten the harvest cycle. This is an improvement over the original systems. However, difficulties arise because the ice cubes produced are wet and tend to stick together.

In other apparatus such as those which are disclosed in Canadian Patent Nos. 1,008,262 and 1,118,219 warm water inundates an upper holding tank or cavity which surrounds horizontally disposed cup-shaped ice making receptacles.

Finally, U.S. Pat. No. 4,412,429 discloses the use of a plastic jacket which is filled with tap water to surround the ice products and hasten the melting.

All of the aforementioned arrangements are effective to a certain degree in reducing ice harvest time, but all tend to melt significant amounts of the ice prior to release.

Another method of hastening the ice cycle is to use ejector rods in conjunction with a grid member. The ejector rods are forced between the grid members to release the ice cubes. However, some amount of melting is still necessary before the ejector rods can work efficiently.

Storage Ice Freezing

A major problem with melting some if not all of the outer surface of ice cubes is that the ice is wet when it reaches the storage area. When the ice is again frozen in storage, the ice cubes tend to stick together making usage difficult.

Non-Symmetrical Shape

Most of the commercial ice makers known in the art do not produce symmetrical ice cubes, but rather cylinders, cups or fragments. This is particularly true of the high volume ice makers.

SUMMARY OF THE INVENTION

The present invention seeks to provide a high volume commercial ice maker with rapid freezing and harvest cycles which produces "dry" ice that has little tendency to stick together in storage. The ice leaves a freezing plate at −30° F. and inertia cools the cubes such that they are dry on impact.

Also this invention seeks to provide substantially symmetrical clear ice cubes.

Therefore this invention provides an ice cube making apparatus comprising:

an evaporator, including at least one freezing surface and a plurality of rectangular channel ways for transporting refrigerating fluid, said channel ways being parallel and contiguous, and being arranged such that substantially the entire area of said freezing surface is in contact with one side of said channel ways;

said channel ways being individually connected to a disperser and at least one outlet manifold;

supply means for delivering cooled refrigerant fluid to said system of channel ways during a freezing cycle to effect rapid cooling of the freezing surface;

ice forming means defining a series of compartments for the formation of individual ice cubes, said compartments being arranged such that, when in operation, each compartment is bounded by an open side being adjacent said freezing surface, a closed wall bearing a central aperture opposite to said open side, two solid walls lying in the vertical plane, and an upper and lower slotted side in the horizontal plane, said slotted sides allowing water to pass through said compartments;

means for cascading water in a sheeting action directly against said freezing surface, said water cascading progressively outwards of said freezing surface as ice forms;

means adapted to deliver refrigerating fluid in the hot gaseous state in a harvest cycle to effect rapid warming of the freezing surface, thereby melting the ice surface in contact with said freezing surface, and permitting said ice forming means to be released;

a means to move said ice forming means away from said freezing surface during the harvest cycle;

an ejector means to remove ice cubes from said ice forming means; and means to return said ice forming means to an operative position at the commencement of the freezing cycle.

In a preferred embodiment of the invention, a vertically disposed evaporator is equipped with freezing surfaces constructed of copper plate on both sides. A series of horizontal parallel rectangular shaped hollow conduits or channel ways for conducting refrigerating fluid is located between the two freezing surfaces. These channel ways are individually directly connected to a disperser and at least one outlet manifold or suction header. In an alternative embodiment, two or three of the channel ways are connected together to the disperser and the outlet manifold.

On the top portion of the evaporator plate is a water distribution device which is used to cascade water in a sheeting action over the freezing surfaces of the evaporator. In a preferred embodiment, two plastic tubes, one on each side of the evaporator, run parallel to the top of the evaporator and extend its entire length. At the top of the two freezing surfaces of the evaporator is a roughened plastic sheet being in the same plane as the evaporator and being of the same thickness. Water from a fresh water holding tank enters the two plastic tubes from each end. This is necessary to maintain sufficient pressure along the entire length of the plastic tubes. The tubes are located directly against the uppermost portion of the roughened plastic sheet, one on each side thereof. Small holes of approximately 5/64" diameter are located on the lower side of the pipes such that water is directed towards the roughened plastic sheet. Approximately five holes are located in each linear inch of the plastic pipe.

When pressure is maintained at a predetermined level, a water stream emerges from each hole and runs together with streams from adjacent holes once they contact the roughened plastic sheet. The combination of the roughened plastic sheet and the number and size of the water stream holes eliminates beading of the water. This is extremely important as beading causes air to be entrapped in the finished product making it undesirable. Water which falls over the evaporator with no beading effect, as in the present invention, will freeze with no entrapped air or contaminant, thus producing a clear ice cube.

At the bottom of the evaporator is a drain pan which catches the water that is not frozen as it cascades down the sides of the evaporator plate. This water is directed to the fresh water holding tank where it is recycled back to the distribution device by means of a pump. On each recycling of the water heat is removed.

Abutting against both the freezing surfaces are nylon ice cube making trays with numerous symmetrically arranged ice forming units or compartments. The units from top to bottom are divided by a series of comb-like projections, such that water may pass in a slightly restricted manner from the upper ice forming units to the lower ice forming units. With each successive pass of water a thin layer of ice forms on the ice forming surface. This gradually builds outward from the evaporator to fill the ice forming units until the ice attains a desired thickness.

The desired thickness of the ice may be controlled in a number of ways. One method is to use a timer which shuts off the flow of water over the evaporator thereby ending the freezing cycle. In a preferred embodiment, a sensor such as a probe, a thermocouple or a set of contacts is used. These are connected to a central electrical box which can be in the form of a mini-computer.

The preferred sensor consists of a pair of contacts which are located in one of the ice making compartments adjacent the wall which is furthermost from the evaporator. As ice is made against the evaporator, the flow of water in a sheeting action over the newly formed ice descends further and further away from the evaporator. Eventually, the descending water reaches the two contacts of the sensor and makes a circuit ground between the positive and negative. The sensor is adjusted so that contact must be continuous for six seconds. This avoids the problems of the contact being made inadvertently by splashing water.

Once the ground has been made for six seconds, the signal is sent to the central electrical box or mini-computer. The central electrical box shuts off the flow of ice forming water and closes the flow of refrigerant. Thereafter, a flow of hot gases is sent through the evaporator to initiate the harvest cycle. Only the surface of the ice cubes adjacent the freezing surface is melted or "sweated", allowing the ice trays to separate from the evaporator.

The vertical sides and rear wall which surround the ice forming units or compartments are solid with the exception of a centrally located aperture in the rear wall of each unit. The ice forming units or compartments are in the form of trays which are mounted on an ice cube tray slide support. In a preferred embodiment, the ice cube tray slide supports are mounted in the vertical plane on a frame and are located on each side of an evaporator which is equipped with freezing surfaces on both sides. Adjacent the ice cube trays at a predetermined distance and being vertically disposed is a grid of projection like ejector rods. These ejector rods correspond to the apertures in the rear walls of the ice forming units.

The grid of ejector rods is also mounted on the frame in the vertical plane; one on each side of the tray slide supports. The ejector rods are directed towards the tray slide supports on each side of the evaporator plate.

The evaporator plate and grids of ejector rods are fixedly secured to the frame and do not move. Only the ice cube tray slide supports are supported on the frame on bearings and move. In one position, the grid of ejector rods abut the tray slide support. In a second position, the tray slide support with the ice forming units abut the evaporator plate; and in a third position, the units are a small distance away from the evaporator.

The movement of the tray slide supports is accomplished by the use of piston type air cylinders, such as those made by HENNELLE®, One air cylinder is located on each end of the frame in a central position. The piston rod is connected to a yoke at the mid-section of the yoke. On each end of the yoke, a push rod is fixedly secured. The push rods are also fixedly secured to the side of the cube tray slide supports. The push rods are supported in position by bearings which are mounted in the frame.

A first piston air cylinder, yoke and two push rods move a cube tray slide support on one side of the evaporator. If several evaporators are mounted in the frame, each with a cube tray slide support on each side, the first piston air cylinder, yoke and push rods move all the cube tray slide supports located on one side of the evaporators.

A second piston air cylinder, yoke and two push rods, located at the opposite end of the frame, move the cube tray slide supports on the opposite side of each of the evaporators.

When the freezing cycle ends, the harvest cycle commences. After a predetermined time which is sufficient to melt the surfaces of the cubes adjacent the freezing surface of the evaporator, the cube tray slide supports are moved to a secondary position approximately midway the evaporator and the grids. In this position, the melted surfaces of the cubes refreeze. After a predetermined time, the trays of cubes are forced against the grid of ejector rods suddenly, and the ice cubes are ejected from the ice forming units as the rods pass through the rear wall apertures. Since the temperature surrounding the evaporator is approximately −30° F. the inertia of the fall of the cubes into storage freezes any remaining water on the surface of the cubes before they reach the storage area.

After the harvest cycle is complete and the cubes have been ejected, the ice cube tray slide supports are moved to the operative freezing position with the cube trays abutting the freezing surface, and the liquid feed refrigerant and ice forming water systems are again placed in operation.

DESCRIPTION OF THE DRAWINGS

The invention is more fully described in conjunction with the following drawings wherein.

DETAILED DESCRIPTION OF THE PREFERRED EMBODIMENT

Figure 1:
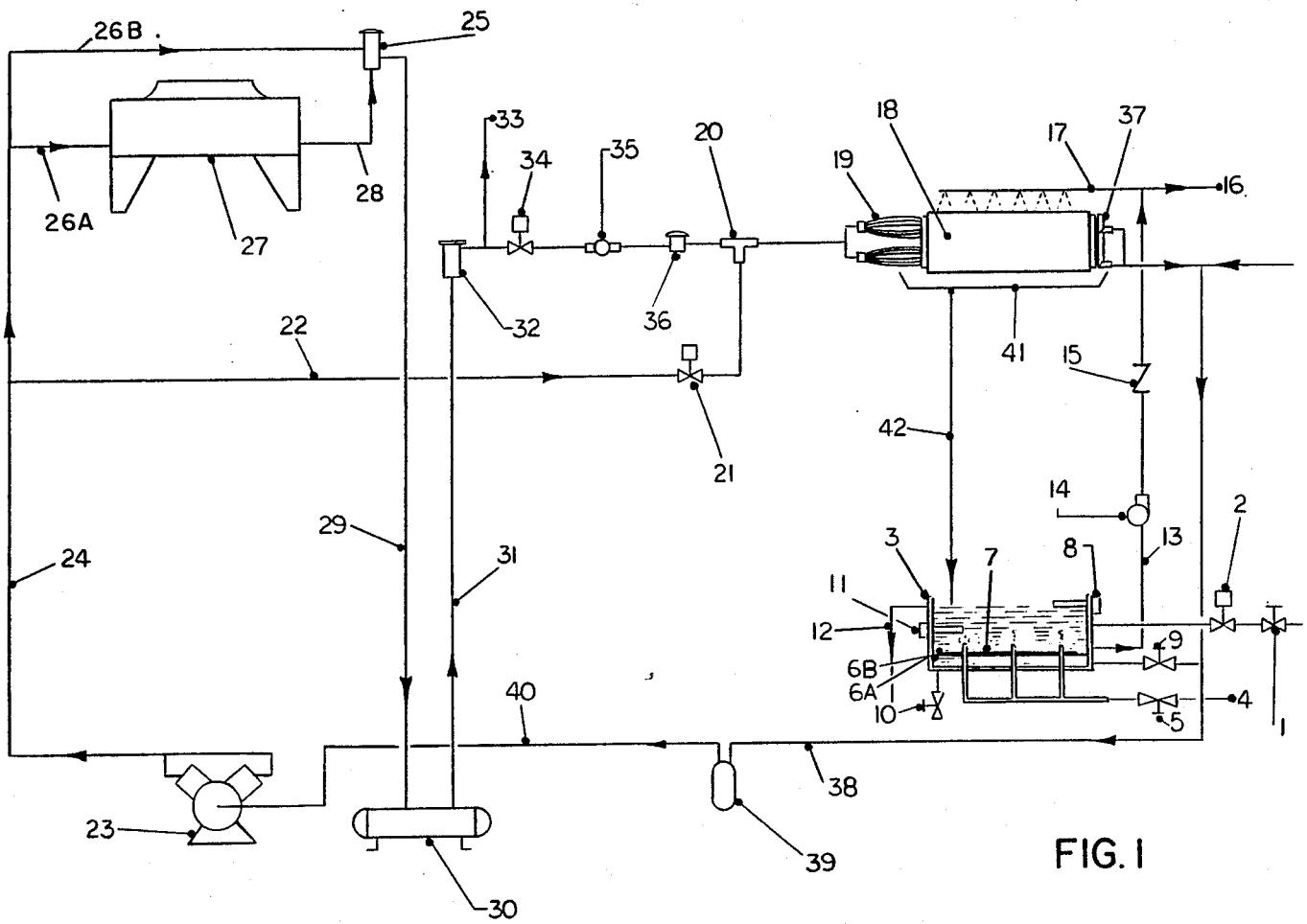
FIG. 1 is a schematic diagram of the various parts of the entire freezing apparatus.

In FIG. 1, the inlet for the fresh water supply is shown as 1. A control valve 2 opens and closes the fresh water supply as required. The water supply 1 which passes through the valve 2 leads to a fresh water tank 3 which is located below the evaporator portion of the apparatus.

An air agitation supply 4 is connected to a shut off valve 5 and is used to supply air to the fresh water tank. The agitation of the water in the fresh water tank with the use of air, serves to clean the water and promotes various foreign solubles such as chlorine in the water to evaporate into the atmosphere. The fresh water tank 3 is equipped with a false bottom 6A and a strainer 6B. This serves to keep any water used for the production of ice, clean and free from dirt. The fresh water tank 3 is also equipped with a cooling coil 7. By keeping the water at a very low temperature, the rate and efficiency of making ice on the evaporator sides (to be discussed later) is increased. The fresh water tank 3 is also equipped with a sensor or float 8 which controls the water level. When the water in the fresh water tank 3 is used to make ice and the water level lowers, the sensor or float 8 activates the control valve 2 thereby allowing fresh water from an outside source to enter. A water valve 9 permits the dirty water below the false bottom 6A to be removed from the tank during cleaning. A drain 10 permits the fresh water tank to be emptied from time to time for cleaning purposes. A temperature sensor 11 activates the cooling coil 7 when the temperature of the water rises. Finally, the fresh water tank is equipped with an overflow pipe 12.

Water leaves the tank through the water line 13 and is pumped upwards by a water pump 14. A check valve 15 keeps water from draining back into the tank when the water pump is not in operation. The water line 13 carries the water to a water disperser 17 which distributes the water in a sheeting action over the freezer plates of the evaporator 18. Water disperser 17 is discussed in more detail in conjunction with FIGS. 5 and 5A. An outlet 16 allows fresh water to travel to other evaporators if a plurality of evaporators are used. Excess water which has not changed to the solid state collects below the evaporator in a drain pan 41 and then passes downwards through a line 42 back to the fresh water tank 3 for recirculation.

A refrigerant disperser 19 disperses the refrigerant to a number of horizontal channel ways within the evaporator.

A compressor 23 is used to compress and pump the refrigerant fluid. From the compressor the refrigerant fluid in a hot compressed state is forced through a refrigerant discharge tube 24. From this point the refrigerant may either proceed to the hot gas bypass 22, the condenser 27, or the condenser bypass 26B. The compressed refrigerant fluid enters the condenser through the condenser inlet 26A and leaves the condenser as liquid feed through line 28. A line 26B allows some refrigerant in the form of hot compressed gas to bypass the condenser and pass through a head pressure control 25 which is used as a control in low ambient operating temperatures. The head pressure control mixes cold liquid feed from line 28 with hot gas 26B in proportions according to the environmental conditions. Condensed refrigerant leaves the pressure head control through refrigerant condensate line 29 to a refrigerant liquid feed receiver 30. Refrigerant in the liquid feed form leaves the refrigerant receiver through a line 31 and passes through a filter dryer 32. The filter dryer 32 is used to remove moisture and other contaminants from the liquid refrigerant feed. From the filter dryer, the supply of liquid refrigerant is controlled by a solenoid valve 34 which opens and closes depending upon the cycle of the ice cube making apparatus. The solenoid is connected to a central electrical center which is in the form of a mini-computer. An outlet 33 allows liquid feed refrigerant to pass to other freezing plates. Refrigerant liquid feed passes through a sight glass 35 which is used to determine if there is air or contaminants in the refrigerant. A total expansion valve 36 is used to allow the refrigerant to pass through an inlet T-valve 20 onwards to a refrigerant disperser 19. When the condensate passes through the total expansion valve 36, it expands and absorbs heat with the pressure drop. The inlet T-valve 20 permits the flow of either refrigerant hot gas feed or refrigerant liquid feed into the disperser, depending upon the cycle. The expanded refrigerant fluid absorbs heat to allow it to vaporize within the evaporator, thereby cooling the evaporator to a point where it will freeze water which comes in contact with the latter. The used, warmed refrigerant leaves the evaporator through an outlet manifold or suction header 37.

In an alternative embodiment, three or four channel ways may be connected to one suction header outlet, depending upon the ambient temperature and the rapidity required for each cycle to be completed. From there refrigerant travels back to the compressor 23 through the refrigerant suction lines 38. A suction line accumulator 39 is placed between the compressor 23 and the suction header(s) 37 and is used to disperse any refrigerant fluid which is still in the liquid feed form. It also removes any oil or other contaminants so that the compressor 23 is not damaged. A suction line 40 takes the refrigerant fluid from the accumulator 39 to the compressor 23.

When the apparatus is in the harvest cycle, the hot compressed refrigerating fluid bypasses the condenser 27 through a hot gas bypass line 22 to a solenoid check valve 21. Once valve 34 is closed, solenoid check valve 21 is opened and refrigerant hot gas feed passes through T-valve 20 to the disperser 19 and into the evaporator 18. In the evaporator the hot gas gives off heat and effects a warming of the freezer plates, thereby melting the layer of ice adjacent the freezer plates. The used and cooled hot gas feed passes out of the evaporator through the suction header(s) 37 and through the return line back to the compressor 23.

Figure 2:
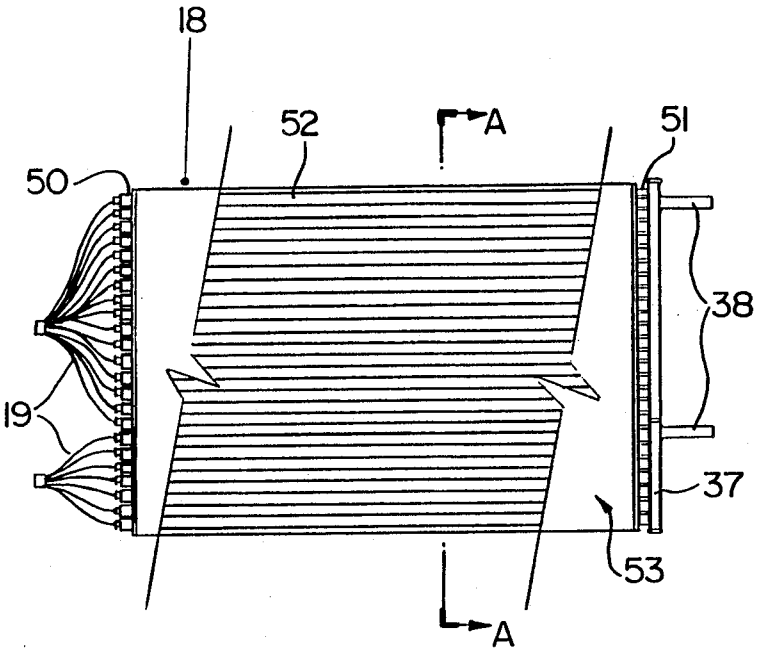
FIG. 2 is an elevational view of the evaporator with a portion of the freezer plate cut away.

In FIG. 2 the evaporator 18 is shown with a cut-away portion of the freezer plate 53. The refrigerant fluid enters through the disperser 19 which comprises a plurality of individual lines which are connected to channel ways 52 which are horizontally disposed adjacent one another between two freezing surfaces or plates 53. In an alternative embodiment, one line may serve three or four channel ways. Generally, the channel ways and freezing plates are made of copper and are roughened on the outside to create a sheeting action of the cascading water. The channel ways are created by a metal sheet of zig zag formation and closed to the outside by means of two freezer plates 53.

In an alternative embodiment, the channel ways can be a plurality of rectangular tubes having openings near one end and mounted horizontally one on top of the other, such that refrigerant can pass from one end of one tube to a first adjacent tube, and then from the opposite end of the first adjacent tube to a second adjacent tube and then to the outlet manifold.

The outlet manifold may be connected to the same end of the manifold as the disperser, when one disperser line serves three or four channel ways. That is to say, if the disperser inlet is connected to channel way number one, the outlet manifold would be connected to channel way number three or four, respectively.

When in operation, the refrigerant is contiguous to all portions of the freezer plate and the heat-transfer efficiency is thus greatly improved. Because the disperser lines 19 are connected directly at 50 to channel ways 52, and the refrigerant passes through each of these channel ways into the suction header(s) 37, all portions of the freezer plate are in contact with the refrigerant fluid at substantially the same temperature, thereby effecting uniform freezing conditions and therefore rapid freezing and harvest cycles.

Figure 3:
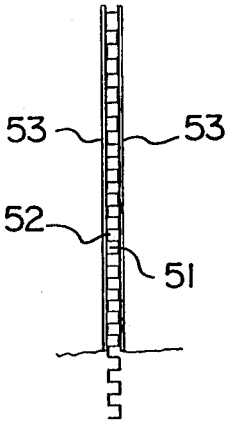
FIG. 3 is a cross-section taken on the line A—A of FIG. 2.

FIG. 3 illustrates the metallic core 51 formed in a zig zag right angled configuration and the two plates 53 placed thereupon. In this manner, each of the channel ways 52 is separated and there is complete exposure of the refrigerant fluid to the freezing plate. In an alternative embodiment, other types of tubing such as serpentine construction may be substituted.

Figure 4:
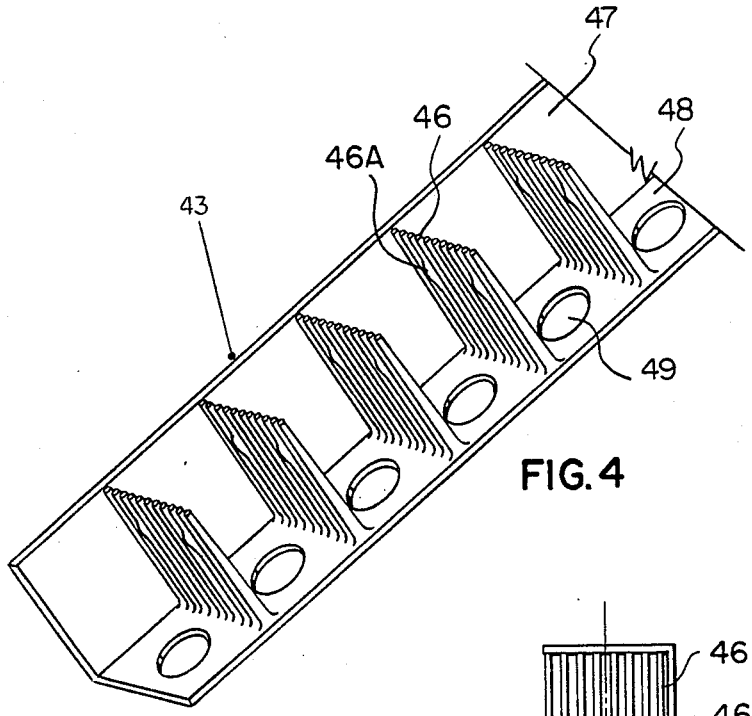
FIG. 4 is a perspective view of a portion of an ice cube tray.
Figure 4B:
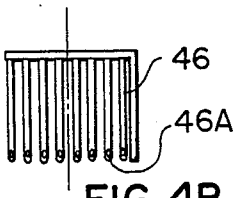
FIG. 4B is a section B of FIG. 4A.

In FIG. 4 an ice cube tray 43 has a side wall 47 and an outer or rear wall 48 formed with apertures 49. The individual ice cubes are formed in compartments between rows of the flexible tapered teeth 46.

Figure 4A:
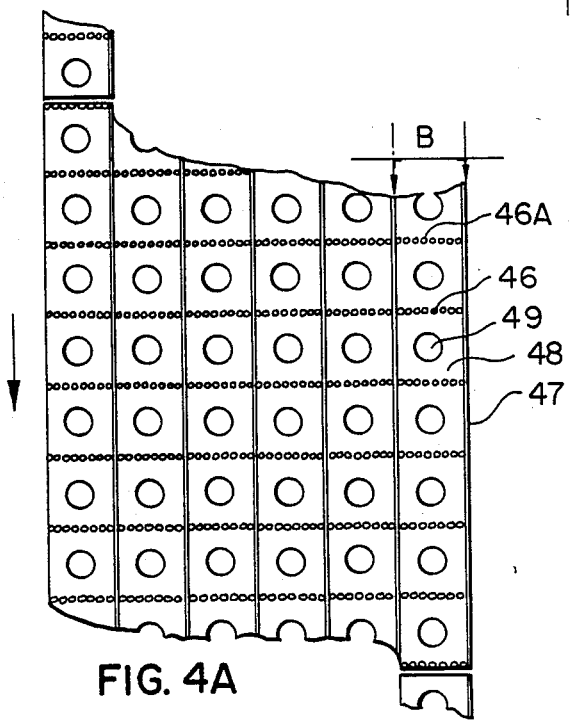
FIG. 4A is a face view of a number of ice forming units mounted for operation.

FIG. 4A is a partial face view of a number of ice cube trays mounted on the ice cube tray support slide. The direction of flow of the water is shown by an arrow. When the two trays 43 are placed together, each ice forming compartment is bounded on two sides by solid vertical walls 47 and rear vertical wall 48 with aperture 49. In operation, the water descends through the slotted sides which are in the form of tooth like projections 46 that lie in the horizontal plane. These projections can be formed with small bumps 46A on their upper sides. These aid in separating and ejecting cubes in the harvest cycle.

Figure 4C:
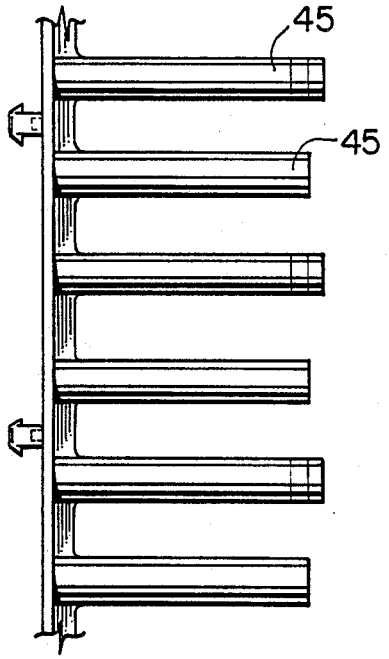
FIG. 4C is a close up side view of a number of push rods.

FIG. 4C is a close up of the push rods 45. These are preferably formed form nylon. The push rods are used to eject the ice cubes from the trays by penetrating the ice forming compartments through aperture 49. The push rods alternate between a longer size and shorter size. Using this design, the load factor which occures when the ice cubes are ejected is staggered such that approximately one half of the cubes are loosened slightly before the others.

Figure 4D:
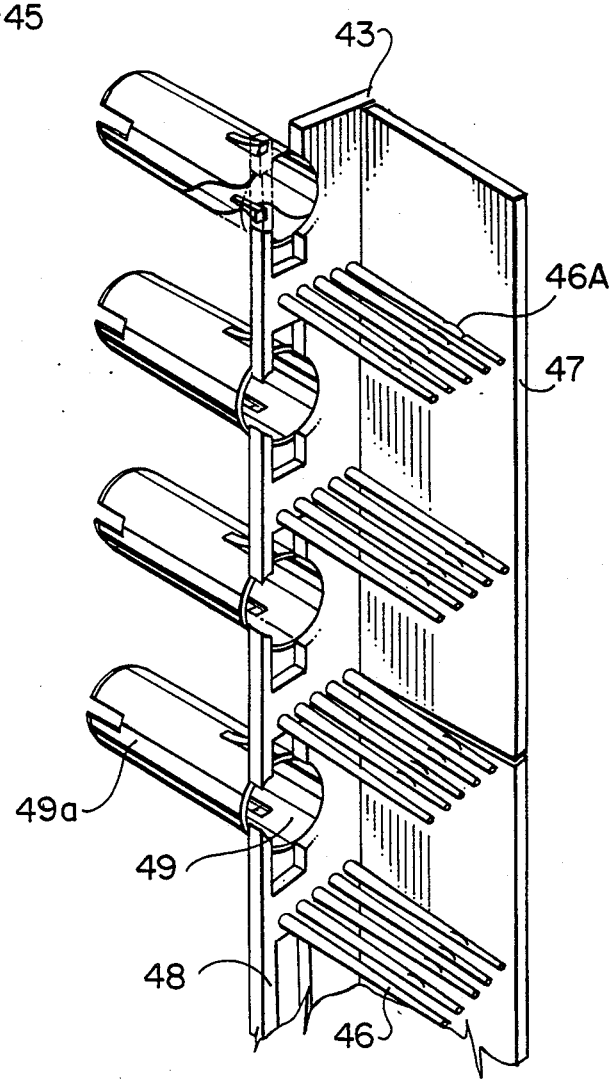
FIG. 4D is a perspective view of a portion of a forming tray equipped with push rod guides.

In FIG. 4D, a preferred embodiment of the ice tray is shown. Behind the aperture 49, a push rod guide 49A is constructed. This insures the nylon push rods 45 are guided directly through aperture 49 when ejection occurs.

Figure 5:
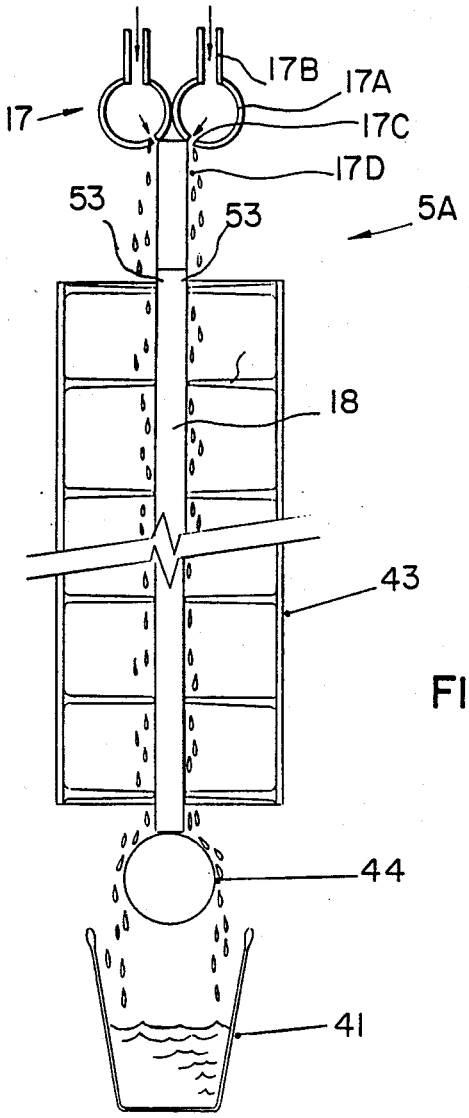
FIG. 5 is an end view of the evaporator and water distribution device of the apparatus in a freezing cycle position.
Figure 5A:
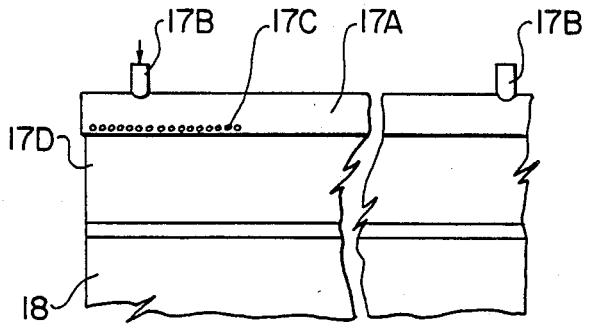
FIG. 5A is a partial face view of the water distribution device and evaporator plate.

FIG. 5 and 5A illustrate the water disperser 17. The water disperser 17 is located above the evaporator 18. In a preferred embodiment, the disperser has two plastic tubes 17, with inlets 17B located towards each end of the tubes. Beneath the disperser tubes and above the evaporator is a roughened plastic sheet 17D lying in the same vertical plane as the evaporator 18, and being of substantially the same thickness. Ice forming water enters the inlets 17B and maintains substantially the same pressure throughout the plastic tubes. The water exists through small holes 17C and is directed against the roughened plastic. In a preferred embodiment, the holes are approximately 5/64" in diameter with five holes per linear inch.

Any configuration is suitable as long as the water streams will join one another on the roughened sheet, thus preventing beading. Beading is detrimental to the formation of clear ice as it causes air to form in the cubes. Air in ice cubes causes the cube to be cloudy, more bulky and absorb food odors.

In FIG. 5, the cube trays are in the ice forming position with the ends of the comb-like teeth 46 abutting against the sides of freezer plates 53 of the evaporator 18. Water passes between the individual teeth in a somewhat restricted flow. When a plurality of cube trays are used, the sides 47 are oriented in the same vertical plane, thereby creating five sided compartments or ice forming units. Ice forms from the open side closest to the ends of the tapered teeth 46 and thickens outwardly in the direction of the aperture(s) 49. A baffle 44 is placed immediately below the bottom of the evaporator to divert ice cubes away from the drain pan 41.

Figure 6:
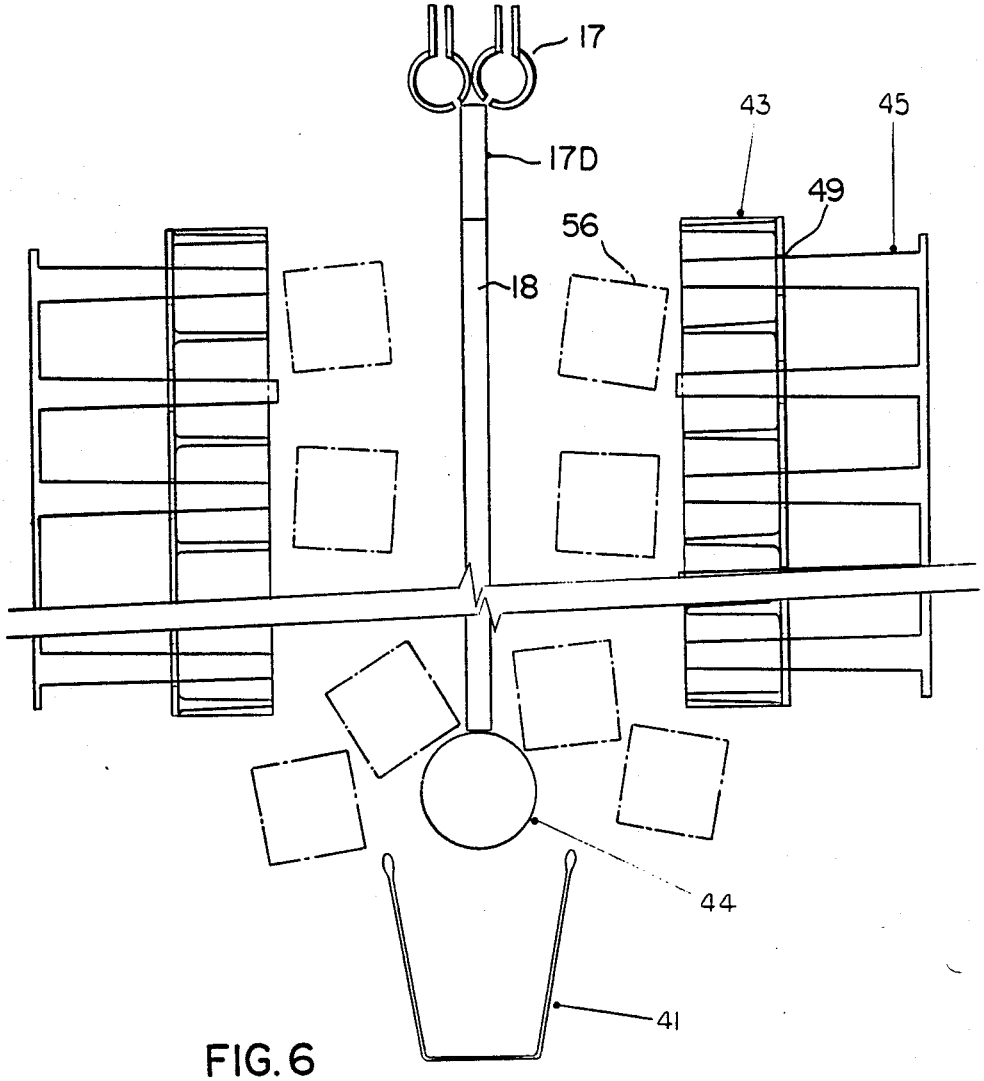
FIG. 6 is similar to FIG. 5 but illustrates the position of the components at the end of the harvest cycle.

FIG. 6 shows the apparatus in the final position of the harvest cycle. Cube ejector rods 45 have passed through the apertures 49 releasing the ice cubes 54.

Figures 7A, 7B, 7C:
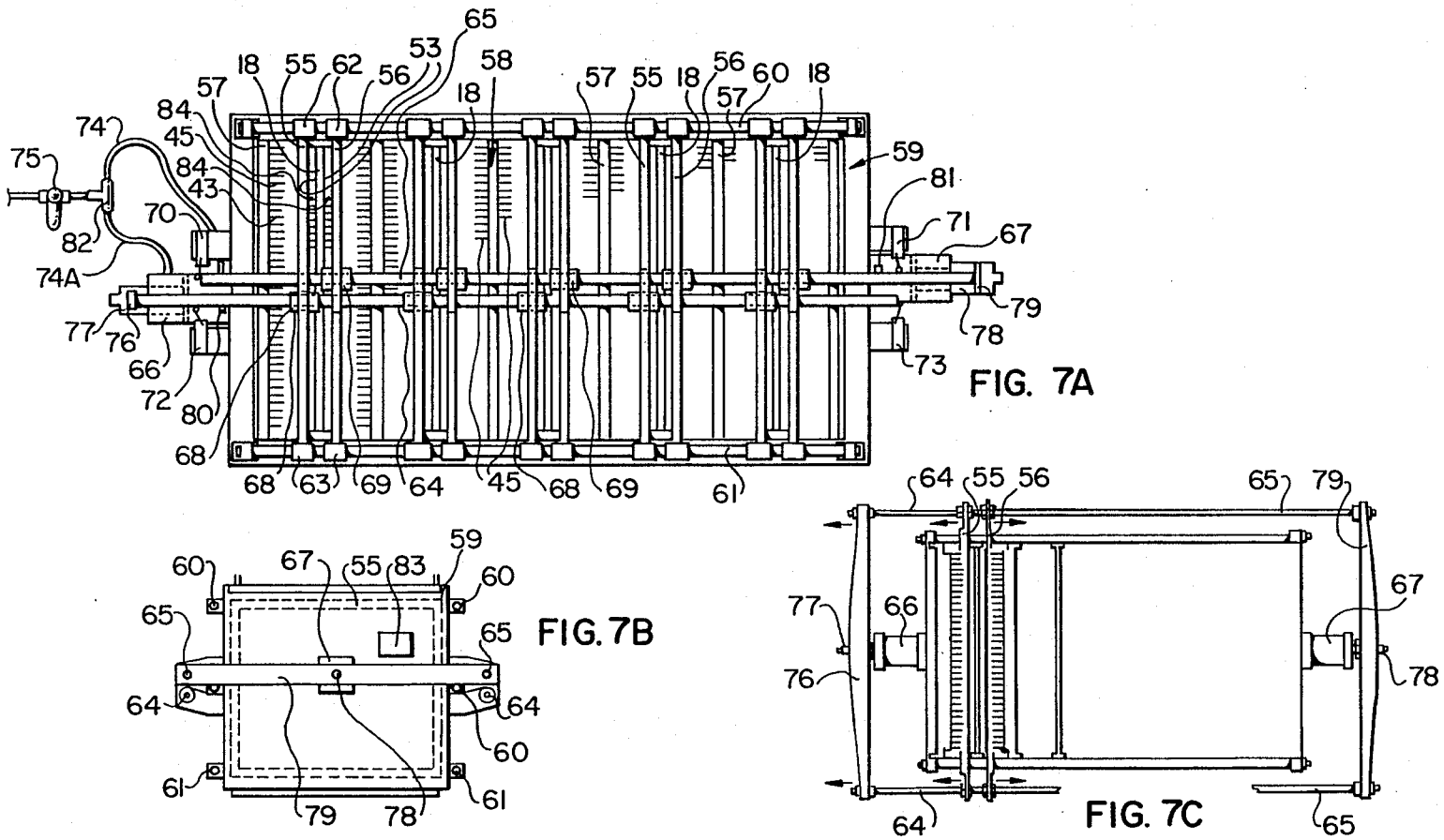
FIG. 7A is a side view of the frame of a commercial application of the invention which has five evaporator plates.
FIG. 7B is an end view of the commercial application.
FIG. 7C is a top view of the invention showing only one two-sided evaporator.

In FIG. 7A is shown a side view of a commercial application of the invention, wherein five evaporators 18 are horizontally disposed within frame 59.

As shown in FIG. 7A, the ice cube trays 43 are attached to cube tray slide supports 55 and 56 which are vertically disposed on either side of the two freezing surfaces 53 of each of the evaporators 18.

The cube tray slide supports 55 and 56 are slidably mounted by means of bearings 62 and 63 on two pairs of fixed slide rods 60 and 61, which are securely fastened on the upper and lower sides of the frame 59 outside of the ends of the evaporators. Left hand cube tray slide supports 55 are fixedly secured at 68 by a suitable means such as welding or threading on push rod 64. Similarly, right hand cube tray slide supports 56 are secured at 69 on push rod 65. The push rod 64 is fixedly attached to all of the left hand cube tray supports. One end of push rod 64 is fixedly attached to the yoke 76, which is fixedly attached to piston 77. Piston 77 is located within air cylinder 66. Piston 7 is moved by compressed air through lines 74 and 74A. Valve 82, which is regulated by the central electrical box or mini-computer 83, opens line 74 or 74A depending on the next cycle.

In FIG. 7A, piston 77, push rod 64, and left hand cube tray slide support 55, are in the freezing or ice making position. Limit switch 73 is in contact with the opposite end of push rod 64. Similarly, push rods 65, yoke 79, piston 78 and right hand cube tray slide supports 56 are also in the freezing position. Limit switch 70 is in contact with the opposite end of push rod 65. Limit switches 70, 71, 72 and 73 are electrically connected to the central electrical box or mini-computer 83. Air is supplied by an air compressor (not shown) through filter 75 to valve 82, to piston cylinders 66 by air hoses 74 and 74A. A similar arrangement of air supply (not shown) is connected to piston cylinder 67. The pistons move the cube tray slide supports 55 and 56 from a first position which abuts the freezing surface 53 of the evaporator 18 to an intermediate position midway between the first position and a harvest position to a third harvest position wherein the cube tray slide supports 55 and 56 abut cube ejector supports 57 to which the push rods 45 are attached. In the harvest position, limit switches 72 and 71 make contact with contacts 80 and 81 respectively. The electrical contact is transmitted to the central electrical box and a signal is forwarded to valve 82 to send air through line 74 to cause piston 77 to move to the right and return cube tray slide support to the freezing position. Similarly, once contact 81 makes contact with limit switch 71, air is supplied to cylinder 67 causing piston 78 to move to the left and move cube tray supports 56 back to the freezing position. Limit switches 70 and 71 control the distance of travel of piston 78 while limit switches 72 and 73 control piston 77 movement.

Figure 8:
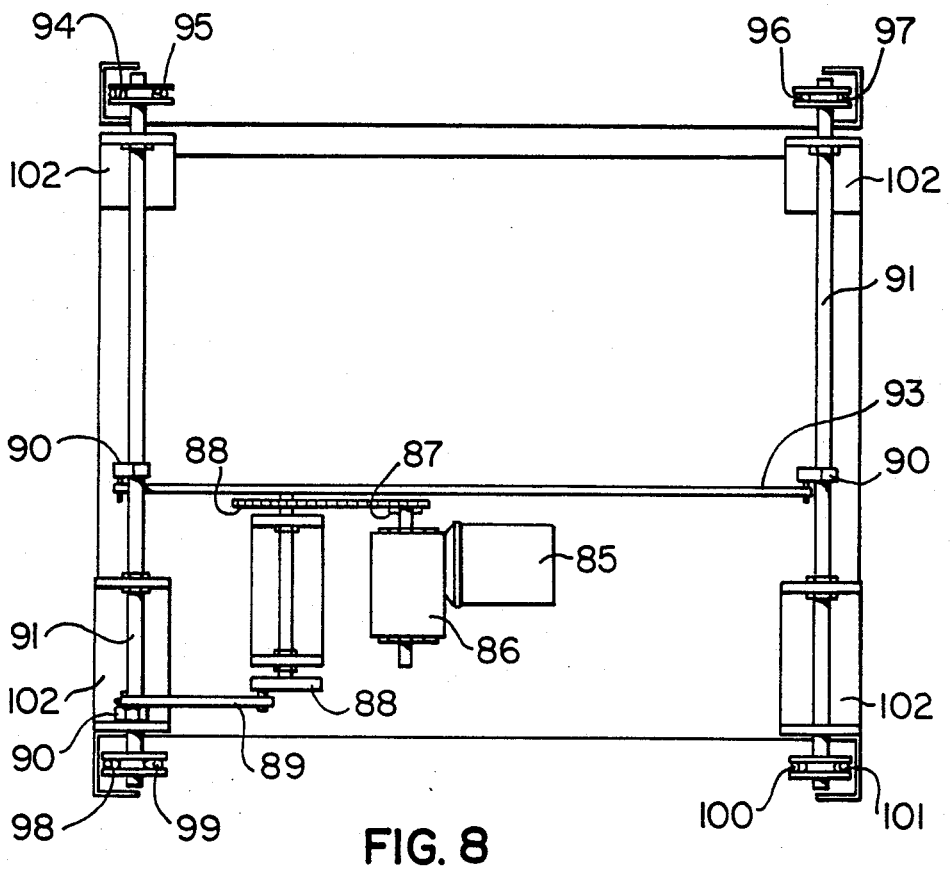
FIG. 8 is an end view of a commercial application of the invention, wherein the moving parts are driven by an electic motor.
Figure 8A:
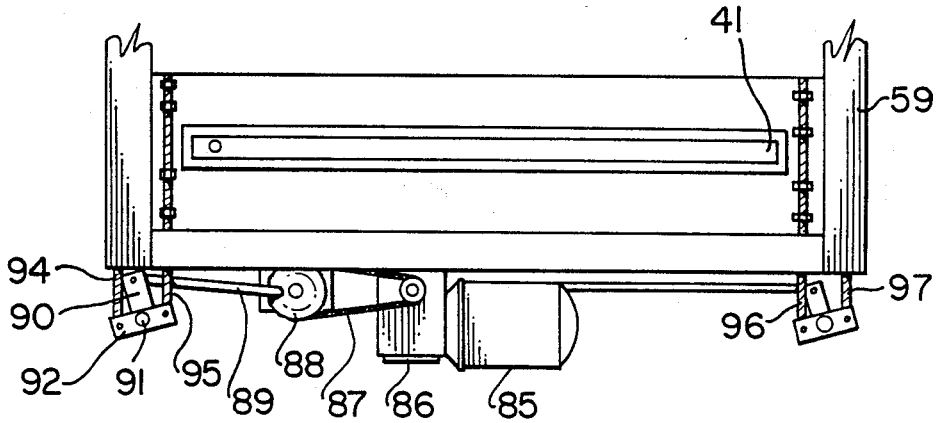
FIG. 8A is a top view of the driving parts shown in FIG. 8.
Figure 8B:
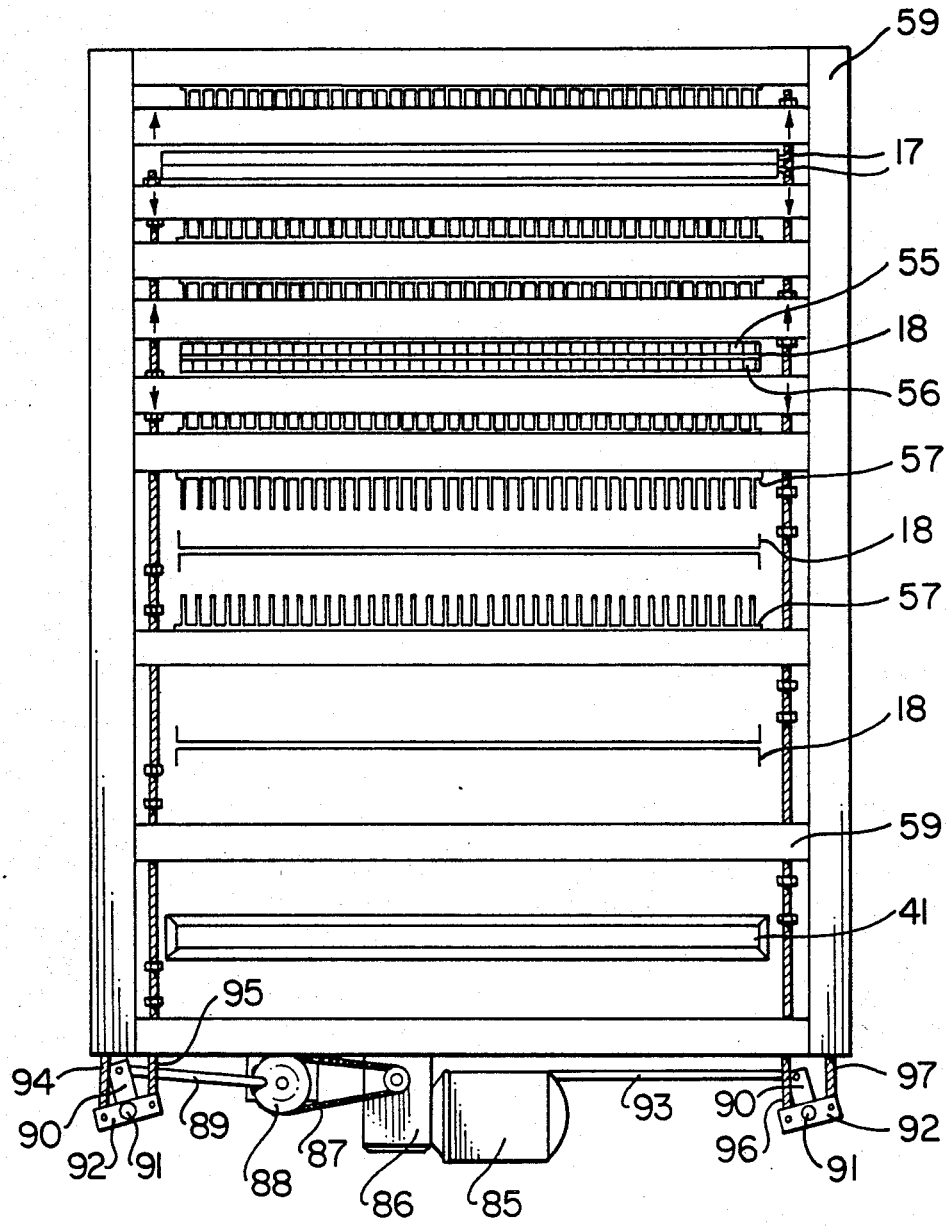
FIG. 8B is a top view of a commercial application of the invention, with the moving parts driven by an electic motor.

In FIG. 8 is shown an alternative embodiment of a commercial application of the invention. Rather than use compressed air cylinders to drive the ice cube slide trays, an electric motor 85, located at one end of the machine, is used. The motor 85 is connected to a gear reducer 86, which in turn is connected to a cam crank 88. A connecting arm 89 is pivotally connected to the cam crank 88 and pivot 90. The latter is fixedly secured to pivot yoke 92. When pivot lever 90 moves back and forth, pivot shafts 91 rotate to the right and left accordingly. The right hand pivot shaft is rotated by means of a center link 93, which is pivotally connected to a pivot lever 90, which is fixed on the left hand shaft 91. The rotating movement of the crank cam 88 is transmitted to push rods 94, 95, 96, 97, 98, 99, 100 and 101. Ice cube tray slide supports 55 and 56 are accordingly moved towards or away from the evaporator plates 88 by the push rods. For example, push rods 94, 96, 98 and 100 move left hand ice cube tray slide supports 55, and push rods 95, 97, 99 and 101 move right hand ice cube tray slide supports 56, respectively, between the freezing and harvest positions. Support brackets 102, attached to the frame 59, maintain the pivot shafts 91 in place.

In operation, pistons 77 and 78 move push rods 64 and 65 and cube tray slide supports 55, 56 respectively towards the evaporator 18 such that the ends of the comb-like teeth 46 of the freezer trays 43 abut against the freezer plates 53. Thereafter, the water pump 14 sends water upwards through the check valve 15 into the disperser 17. In FIG. 3 one notes that the water drips downwards in a sheeting action immediately beside the freezer plate(s) through the comb-like teeth, over the baffle 44, and into the drain pan 41.

At the same time as the water begins to flow during the freezing cycle, the compressor 23 is activated and refrigerant liquid feed from the refrigerant receiver passes through the solenoid valve 34 past the sight glass 35, through the inlet T, and into the disperser 19 where it is circulated through the evaporator and out to the suction header(s) 37, returning again to the compressor. The freezing cycle continues until the thickness of the ice in the cube trays 43 has built up from the freezer plate outwards, to reach the desired thickness.

When the ice reaches the desired thickness, water activates sensor electrical contacts 84 by making a ground. The ground is transmitted to the central electrical box which shuts off the flow of the refrigerant liquid feed at the solenoid valve 34. At the same time the water pump 14 is shut off. Thereafter, refrigerant hot gas feed moves through the hot gas bypass 22 and the solenoid valve 21 opens, allowing the hot gas feed to pass through the inlet T into the disperser and through the evaporator channel ways. The refrigerant hot gas feed passes out of the suction header(s) 37 and descends through the refrigerant line 38 back to the compressor. Meanwhile, the ice surface immediately adjacent the freezer plate begins to rapidly melt. When the surface of the ice cubes 54 adjacent the freezing surface 53, melts for a predetermined amount of time, pistons 77 and 78 are activated by the central electrical control unit and move the cube tray slide supports to a secondary midway position outwardly from the evaporator 18. In the ambient −30° F. temperature, liquid remaining on the melted surface of the ice cubes quickly changes to ice in the secondary position. After a predetermined amount of time, the central electrical control unit activates valve 82, causing pistons 77 and 78 to move to their outward limit, whereupon cube tray slide supports 55 and 56 move the cube trays to cube ejector rods 45 located on the ejector supports 57, and the rods release the ice cubes 54 which fall into a storage area. The baffle 44 keeps the ice from falling in the drain pan 41, and the inertia of the falling ice in the cold ambient environment produces ice cubes which are relatively free of moisture and therefore do not stick together. As soon as the cubes have been ejected, the pistons 77 and 78 again move the cube tray slide supports back to the freezing position shown in FIG. 5, and the solenoid valve 21 shuts off the hot gas feed; the water pump 14 begins again, and the solenoid valve 34 is opened and another freezing cycle takes place. The complete cycle of freezing and harvesting takes place in a very short time and a large volume of clear air-free ice can be thus made.

The apparatus disclosed in the invention can also be used to produce sheet or fragment ice of any thickness when the cube trays are not used. The ice made in this manner usually proceeds to a crusher (not shown) prior to storage.

What is claimed is:

1. An ice cube making apparatus comprising:

an evaporator, including at least one freezing surface and a plurality of rectangular channel ways for transporting refrigerating fluid, said channel ways being parallel and contiguous, and being arranged such that substantially the entire area of said freezing surface is in contact with one side of said channel ways;

said channel ways being connected to a disperser and at least one outlet manifold;

supply means for delivering cooled refrigerant fluid to said system of channel ways during a freezing cycle to effect rapid cooling of the freezing surface;

ice forming means defining a series of compartments for the formation of individual ice cubes, said compartments being arranged such that when in operation, each compartment is bounded by an open side being adjacent said freezing surface, a closed wall bearing a central aperture opposite to said open side, two solid walls lying in the vertical plane, and an upper and a lower slotted side in the horizontal plane, said slotted sides allowing water to pass through said compartment;

means for cascading water in a sheeting action directly against said freezing surface, said water cascading progressively outwards of said freezing surface as ice forms;

means adapted to deliver refrigerating fluid in the hot gaseous state in a harvest cycle to effect rapid warming of the freezing surface, thereby melting the ice surface in contact with said freezing surface, and permitting said ice forming means to be released;

a means to move said ice forming means away from said freezing surface during the harvest cycle;

an ejector means to remove ice cubes from said ice forming means; and means to return said ice forming means to an operative position at the commencement of the freezing cycle.

2. An apparatus as claimed in claim 1, wherein said means for cascading water in a sheeting action comprises a pump, a drain pan, a fresh water holding tank, and a distribution means; said pump, drain pan, holding tank and distribution means being in closed communication with one another, thereby allowing for recirculation of unfrozen water.

3. An apparatus as claimed in claim 2 wherein an outside source of fresh water is connected to said means for cascading water, the inflow of said fresh water being controlled by a valve means.

4. An apparatus as claimed in claim 3 wherein said valve means is connected to a float type sensor; said float type sensor controlling the inflow of fresh water according to the level of water in said holding tank.

5. An apparatus as claimed in claim 2 wherein said distribution means comprises a series of conduits with perforations; said perforations directing the flow of ice forming water under pressure against an uneven surface in numerous small streams, such that said ice forming water descends in a sheeting action over said ice forming means.

6. An apparatus as claimed in claim 1 wherein said supply means in order of the direction of flow, comprises a compressor, a condenser, a receiver, a disperser, and an accumulator; said supply means being in closed communication with said system of channel ways.

7. An apparatus as claimed in claim 1 wherein said evaporator has two freezing surfaces and is vertically disposed; and said rectangular channel ways are horizontally disposed one on top of another wherein opposite sides of each channel way comprise a freezing surface.

8. An apparatus as claimed in claim 7 wherein said channel ways are constructed of rectangular tubing.

9. An apparatus as claimed in claim 1 wherein said evaporator comprises an inner core constructed of a sheet of metal bent at right angles, thereby forming three sided parallel channel ways, and a freezing plate applied to opposite sides of said core thereby enclosing each channel way.

10. An ice cube making device as claimed in claim 1 wherein said means to move said ice forming means includes at least one piston, yoke and push rod fixedly mounted to said ice forming means, said piston being housed within a cylinder and urging said ice forming means in the direction of said ejector means and away therefrom depending upon the cycle; and said piston being powered by compressed air.

11. An ice making apparatus as claimed in claim 1 wherein said ejector means includes a plurality of equidistant ejector rods mounted on, and perpendicular to, a stationary cube ejector support; said cube ejector support being parallel to and of substantially the same area as said freezing surface,

12. An ice forming means as claimed in claim 1 wherein a number of compartments are connected together to form a tray and said two slotted sides of said compartments which lie in the horizontal plane are so positioned and configured that when in operation during a harvest cycle, ice cubes can be freed from the tray without interference from ice formed in interconnecting adjacent compartments.

13. An ice cube tray as claimed in claim 12 wherein said slotted sides are in the form of tapered tooth-like projections that have tips which abut the freezer plate during the freezing cycle.

14. An ice cube forming means as claimed in claim 1, wherein said apertures of said closed walls are adapted to accommodate said ejector means.

15. An ice cube tray as claimed in claim 12, wherein said tray is constructed of a flexible nylon material.

16. An ice cube forming means as claimed in claim 1 comprising an array of compartments arranged in successive rows; said forming means including a plurality of discrete sections each of which contains one of said rows.

17. An ice cube tray as claimed in claim 12 wherein each tray contains a single row of compartments, said slotted sides being dividing partition walls separating successive compartments in the row.

18. An ice cube tray as claimed in claim 17 wherein each of said dividing partition walls defines a row of tapered tooth-like projections that have tips substantially located in a common plane.

19. An ice cube tray as claimed in claim 18 wherein each compartment of said tray includes an open side which lies parallel to said row of compartments, said open side being closed by a solid wall of an adjacent ice cube tray, when in operation.

20. An ice cube tray as claimed in claim 19 wherein said open side of each compartment is located on the same side of said tray.

21. An ice cube tray as claimed in claim 17, wherein each of said compartments includes a wall with an aperture adapted to receive an ejector rod in one wall.

22. An ice cube tray as claimed in claim 12 wherein each compartment is defined in part by two adjacent trays.

23. An ice cube maker as claimed in claim 2, wherein said holding tank is equipped with an air agitation means for the purification of ice forming water.

* * * * *